US010595635B2

(12) United States Patent
DuFresne

(10) Patent No.: US 10,595,635 B2
(45) Date of Patent: Mar. 24, 2020

(54) ASSEMBLY FOR MOUNTING AND INDEPENDENT MULTI-DIRECTION ADJUSTMENT OF A SEAT BACK

(71) Applicant: The Comfort Companies, LLC, Bozeman, MT (US)

(72) Inventor: Steven DuFresne, Hartland, WI (US)

(73) Assignee: THE COMFORT COMPANIES, LLC, Bozeman, MT (US)

( * ) Notice: Subject to any disclaimer, the term of this patent is extended or adjusted under 35 U.S.C. 154(b) by 0 days.

(21) Appl. No.: 16/266,452

(22) Filed: Feb. 4, 2019

(65) Prior Publication Data

US 2019/0239649 A1 Aug. 8, 2019

Related U.S. Application Data

(63) Continuation of application No. 15/344,348, filed on Nov. 4, 2016, now Pat. No. 10,194,745.

(60) Provisional application No. 62/252,267, filed on Nov. 6, 2015.

(51) Int. Cl.

| | |
|---|---|
| ***A47C 1/02*** | (2006.01) |
| ***A47C 1/027*** | (2006.01) |
| ***A47C 7/42*** | (2006.01) |
| ***A47C 1/024*** | (2006.01) |
| ***A61G 5/10*** | (2006.01) |

(52) U.S. Cl.

CPC ..... *A47C 1/027* (2013.01); *A47C 1/0246* (2013.01); *A47C 7/42* (2013.01); *A61G 5/10* (2013.01); *A61G 5/1064* (2013.01); *A61G 5/1067* (2013.01); *A61G 2203/78* (2013.01)

(58) Field of Classification Search

CPC ..... A47C 1/027; A47C 1/0246; A47C 7/42; A61G 5/10

USPC ..... 297/361.1, 440.2, 284.4, 284.5, 354.11, 297/354.12

See application file for complete search history.

(56) References Cited

U.S. PATENT DOCUMENTS

| | | | | |
|---|---|---|---|---|
| 2,124,006 | A | 7/1938 | Parker | |
| 3,640,571 | A | 2/1972 | Keropian | |
| 3,730,589 | A | 5/1973 | Lane | |
| 4,073,537 | A | 2/1978 | Hammersburg | |
| 4,170,382 | A * | 10/1979 | Wheeler | A47C 7/443 297/300.5 |
| 5,062,677 | A | 11/1991 | Jay et al. | |
| 5,127,709 | A | 7/1992 | Rubinstein et al. | |
| 5,211,446 | A | 5/1993 | Jay et al. | |
| 5,332,287 | A | 7/1994 | Whitmyer | |
| 5,364,162 | A | 11/1994 | Bar et al. | |
| 5,556,168 | A * | 9/1996 | Dinsmoor, III | A61G 5/1067 297/440.2 |
| 5,593,211 | A | 1/1997 | Jay et al. | |
| 5,669,536 | A | 9/1997 | Wang | |
| 5,848,824 | A | 12/1998 | Mocur | |
| D413,085 | S | 8/1999 | Bar et al. | |
| 5,944,385 | A | 8/1999 | Pearce | |

(Continued)

*Primary Examiner* — Mark R Wendell
(74) *Attorney, Agent, or Firm* — Michael Best & Friedrich LLP

(57) ABSTRACT

A seat back angle and depth adjustment assembly includes an angle adjustment member that includes a first aperture and a second aperture, a first fastener is received by the first aperture and is configured to engage an angle adjustment locking member, and a second fastener is received by the second aperture and is configured to engage a depth adjustment locking member.

20 Claims, 12 Drawing Sheets

(56) References Cited

U.S. PATENT DOCUMENTS

| | | | | |
|---|---|---|---|---|
| 5,971,417 | A | 10/1999 | Swisshelm et al. | |
| 5,971,471 | A | 10/1999 | Gardner | |
| 6,257,664 | B1 | 7/2001 | Chew et al. | |
| 6,390,426 | B1 | 5/2002 | Berry | |
| 6,460,933 | B1 | 10/2002 | Bors et al. | |
| 6,474,743 | B1 | 11/2002 | Harker et al. | |
| 6,659,563 | B2 | 12/2003 | Float et al. | |
| 6,688,693 | B2 | 2/2004 | Christofferson et al. | |
| 6,733,074 | B2 | 5/2004 | Groth | |
| 6,886,843 | B1 * | 5/2005 | Papac | A61G 5/00 280/250.1 |
| 6,889,993 | B2 | 5/2005 | Chen et al. | |
| 7,104,610 | B2 | 9/2006 | Cramer | |
| 7,891,739 | B2 | 2/2011 | Cramer | |
| 8,567,863 | B2 | 10/2013 | Hetzel et al. | |
| 2008/0217880 | A1 * | 9/2008 | Whelan | A61G 5/10 280/250.1 |
| 2015/0245964 | A1 * | 9/2015 | Tsuber | A61G 5/1067 297/363 |
| 2017/0087037 | A1 * | 3/2017 | Scarlett | A61G 5/12 |

* cited by examiner

ASSEMBLY FOR MOUNTING AND INDEPENDENT MULTI-DIRECTION ADJUSTMENT OF A SEAT BACK

CROSS-REFERENCE TO RELATED APPLICATIONS

This application is a continuation of U.S. patent application Ser. No. 15/344,348, filed on Nov. 4, 2016 and entitled "Assembly for Mounting and Independent Multi-Direction Adjustment of a Seat Back," which claims priority to U.S. Provisional Patent Application No. 62/252,267, filed on Nov. 6, 2015 and entitled "Assembly for Mounting and Independent Multi-Direction Adjustment of a Seat Back," the contents of each is hereby incorporated by reference in its entirety.

FIELD

The present disclosure relates to an assembly for mounting and adjusting a seat back. More specifically, the present disclosure relates to an assembly that mounts a seat back, and also provides independent multi-direction adjustment of the seat back.

SUMMARY

In some embodiments, a seat back angle and depth adjustment assembly includes an angle adjustment member that includes a first aperture and a second aperture. A first fastener is received by the first aperture and is configured to engage an angle adjustment locking member. A second fastener is received by the second aperture and is configured to engage a depth adjustment locking member.

In other embodiments, a chair having a seat back angle and depth adjustment assembly includes an angle adjustment member that includes a first arcuate aperture and a second aperture. A first fastener is received by the first arcuate aperture and is configured to engage an angle adjustment locking bracket that is positioned on a first side of a mounting member. A second fastener is received by the second aperture and is configured to extend through a slot defined by the mounting member to engage a depth adjustment locking bracket that is positioned on a second side of the mounting member.

In yet other embodiments, a seat back angle and seat back depth adjustment assembly includes a first bracket that includes a first aperture and a second aperture, a first fastener that is received by the first aperture and is configured to engage a second bracket, and a second fastener that is received by the second aperture and is configured to engage a third bracket.

In yet other embodiments, a seat back angle and seat back depth adjustment assembly includes a first state where an angle adjustment member is configured to slide along a portion of a connection mount while a first fastener remains engaged with a first bracket. The assembly also includes a second state where the angle adjustment member is configured to rotate with respect to a second fastener while the second fastener remains engaged with a second bracket. The assembly further includes a third state where the angle adjustment member is configured to both slide along the portion of the connection mount and rotate with respect to the second fastener.

Other aspects of the invention will become apparent by consideration of the detailed description and accompanying drawings.

DETAILED DESCRIPTION

Before embodiments of the disclosure are explained in detail, it is to be understood that the disclosure is not limited in its application to the details of construction and the arrangement of components set forth in the following description or illustrated in the accompanying drawings. The disclosure is capable of supporting other embodiments and of being practiced or of being carried out in various ways.

While the present disclosure illustrates a seat back mounting assembly 10 for use with a wheelchair, it should be appreciated that a wheelchair is provided for purposes of illustration and is not limiting. The seat back mounting assembly 10 can not only be used with a wheelchair, but also in association with any suitable chair, including, but not limited to, an armchair, rocking chair, car seat, swivel chair, office chair, recliner, director's chair, high chair, sofa, backed stool, or any other suitable device for supporting a person while sitting.

Referring now to the Figures, an embodiment of the seat back mounting assembly 10 is illustrated in FIGS. 1-6. The seat back mounting assembly 10 is depicted as a left side or left orientation mounting assembly. The left side mounting assembly is configured to mount a seat back (not shown) to a left side back post (or wheelchair cane or back cane, not shown), the left side being viewed when facing a backside of the wheelchair (not shown), or by a user sitting in the wheelchair. A non-limiting example of a suitable seat back and a wheelchair cane for use with the mounting assembly 10 is disclosed in U.S. Pat. No. 7,891,739, which is incorporated by reference herein in its entirety.

Figure 1:
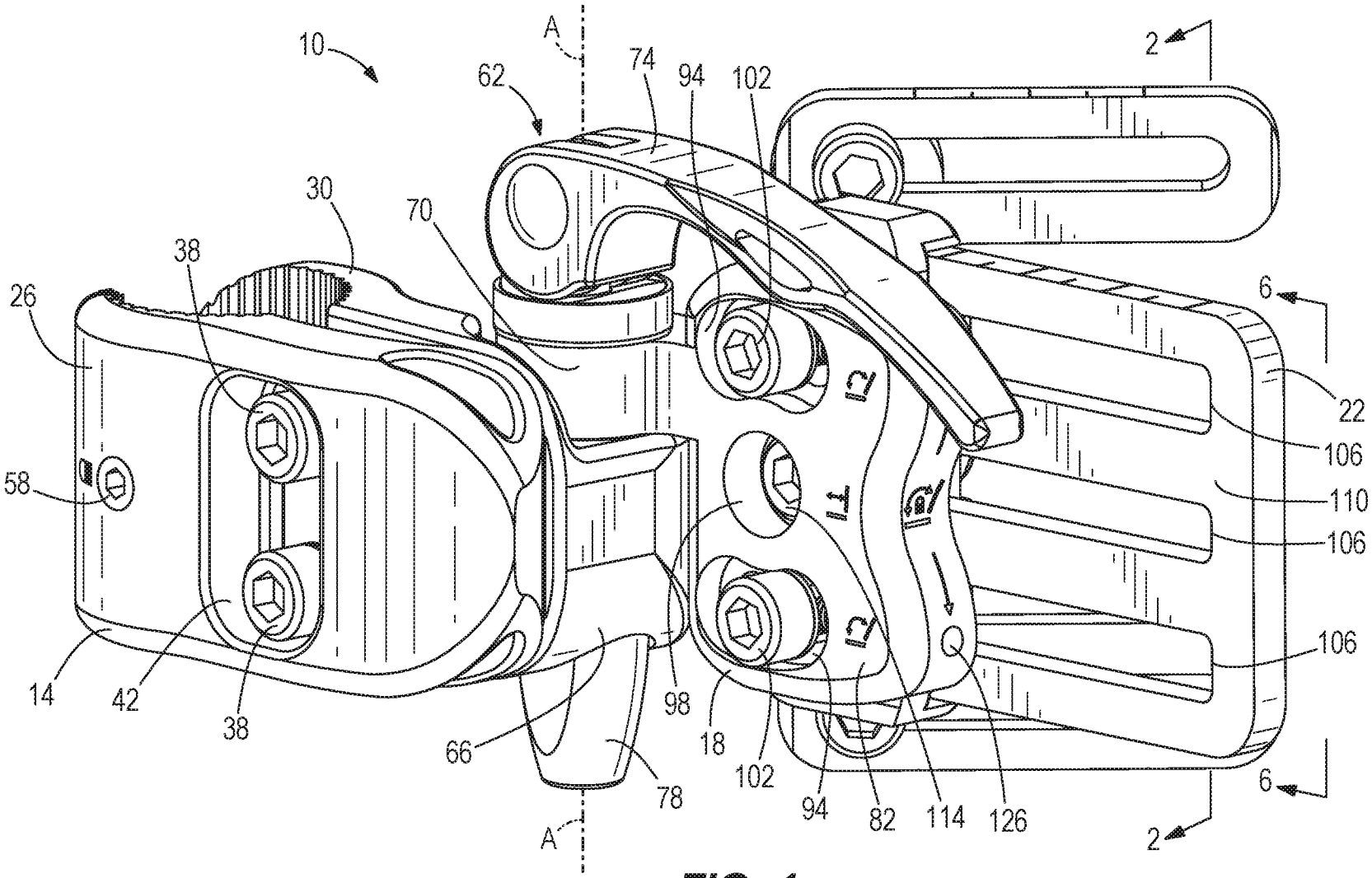
FIG. 1 is a perspective view of an embodiment of a seat back mounting assembly.
Figure 3:
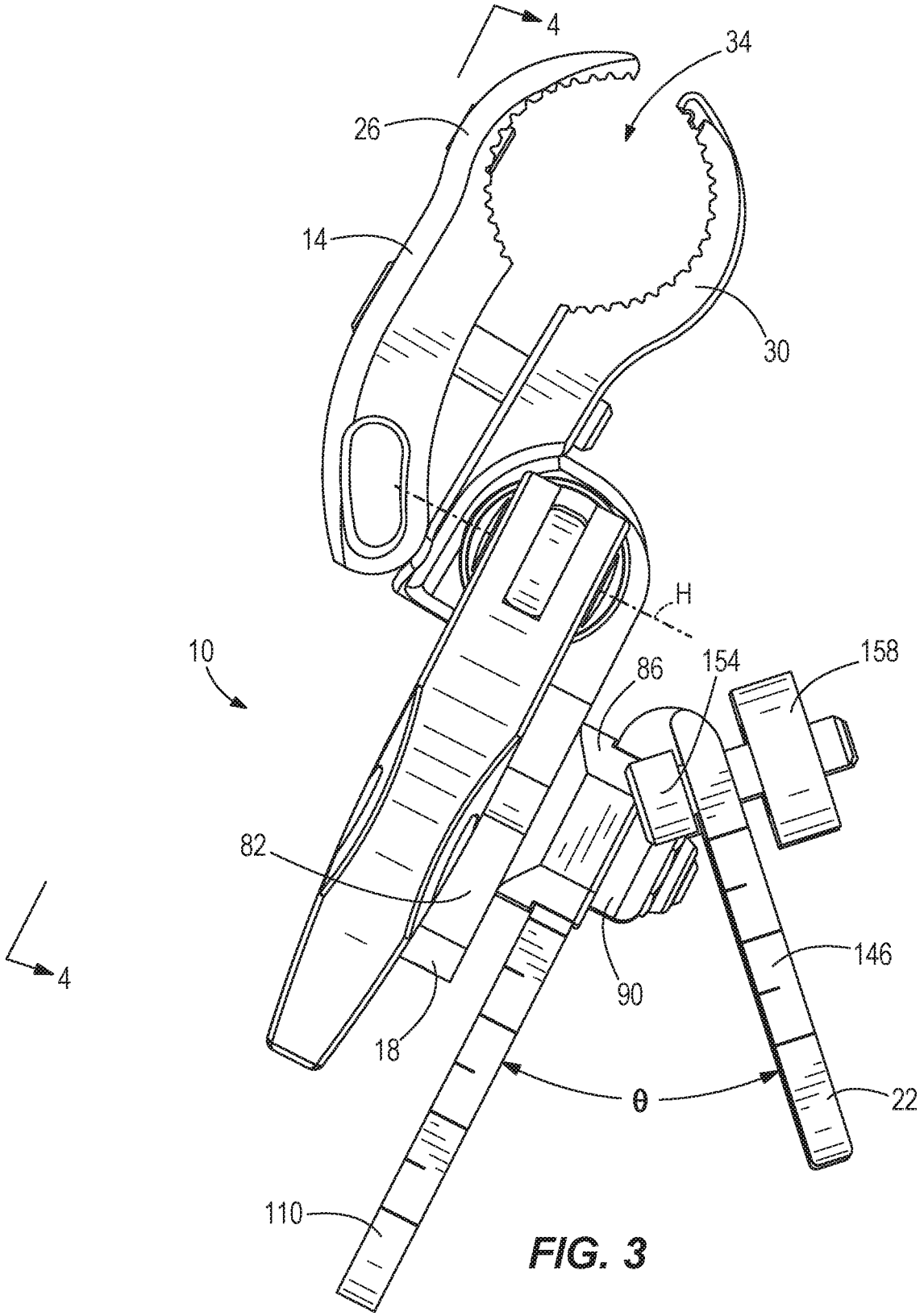
FIG. 3 is a plan view of the seat back mounting assembly of FIG. 1, taken along line 3-3 of FIG. 2.
Figure 4:
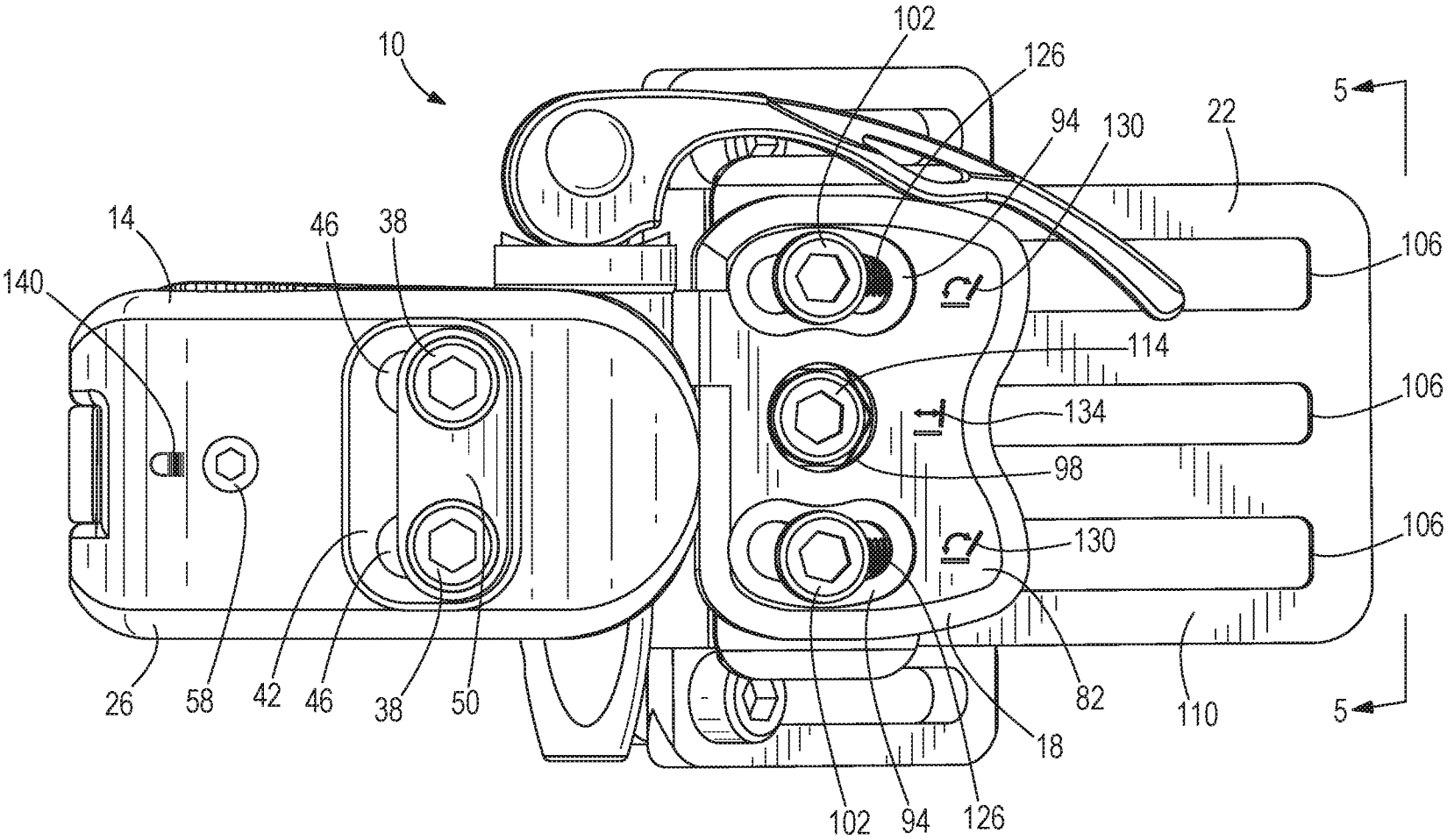
FIG. 4 is a second side view of the seat back mounting assembly of FIG. 1, taken along line 4-4 of FIG. 3.

With reference to FIGS. 1, 3, and 4, the seat back mounting assembly 10 includes a clamp 14 (or a cane clamp 14) that is removably connected to an independent seat back angle and depth adjustment assembly 18. The angle and depth adjustment assembly 18 is removably connected to a seat back connection mount 22. The cane clamp 14 is configured to engage or receive one of the canes of a wheelchair (not shown), while the seat back connection mount 22 is configured to connect to the seat back (not shown) of the wheelchair (or other suitable chair). The independent seat back angle and depth adjustment assembly 18 is configured to allow for independent adjustment of a seat back depth relative to the cane, and a seat back angle relative to the cane. Stated another way, the seat back depth can be adjusted while maintaining (or without affecting) the seat back angle, and the seat back angle can be adjusted while maintaining (or without affecting) the seat back depth.

With reference to FIG. 3, the cane clamp 14 includes a first clamp arm 26 (or a first clamp portion 26) and a second arm 30 (or a second clamp portion 30) that together define a cane aperture or passage 34. The passage 34 is configured to engage or couple to a portion of a wheelchair cane (not shown) or other upright member of any other type of chair. As illustrated in FIGS. 1 and 4, the first and second clamp arms 26, 30 are removably and adjustably connected by a plurality of fasteners 38 (illustrated as bolts 38). Each fastener 38 can be received by a recess 42 defined in the first clamp arm 26. The recess 42 includes a plurality of first slots 46 (shown in FIG. 4) that extend through the first clamp arm 26. Each of the first slots 46 is configured to receive one of the fasteners 38. As shown in FIG. 4, the fasteners 38 can also be received by a washer 50 (or washer carrier 50). The washer 50 can be a unitary washer configured to carry the plurality of fasteners 38. In addition, the washer 50 can be received (or partially received) by the recess 42. In other embodiments, each fastener 38 can be received by a separate washer 50. Once received by the respective first slot 46 in the first clamp arm 26, each fastener 38 can be received by a corresponding second aperture 54 that extends through the second clamp arm 30, shown in FIG. 2. Each second aperture 54 can engage the received fastener 38 to couple the first and second arms 26, 30. For example, the second aperture 54 can include threads that are configured to engage with complimentary threads on the fastener 38. In other embodiments, the fasteners 38 can engage with a retention member or a threaded member, such as a nut, after being received by the second aperture 54 to facilitate the connection between the first and second clamp arms 26, 30. The illustrated clamp assembly 14 can include a locking set screw 58, which is shown in FIGS. 1 and 4. In the illustrated embodiment, the set screw 58 is positioned through the first clamp arm 26 and is configured to engage a portion of the wheelchair cane that is received by the passage 34, and that is engaged by the first and second clamp arms 26, 30. In other examples of embodiments, the clamp assembly 14 can include a set screw 58 that is positioned through the second clamp arm 30, through both the first and second clamps arms 26, 30, or no set screw 58 at all.

Figure 2:
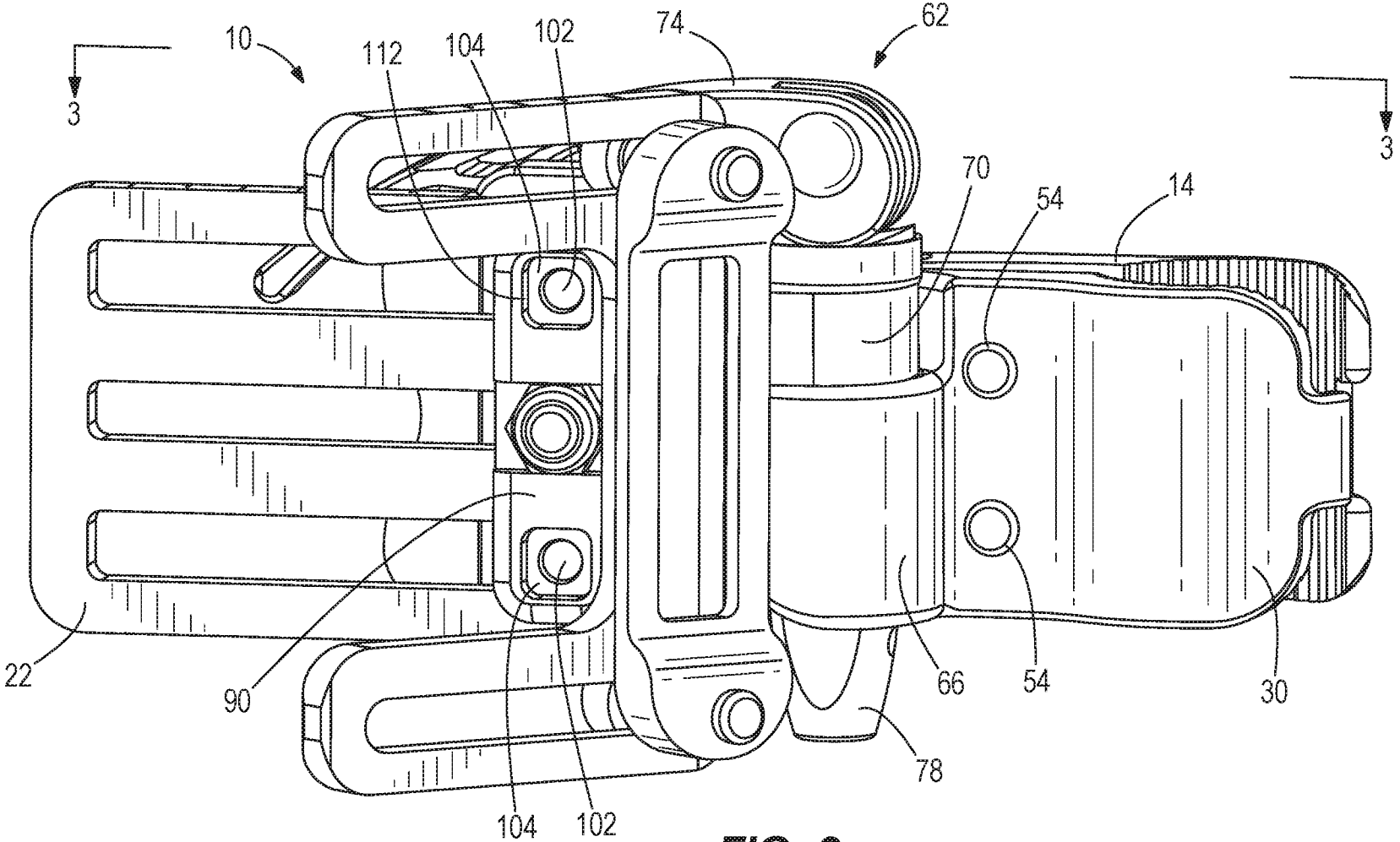
FIG. 2 is a first side view of the seat back mounting assembly of FIG. 1, taken along line 2-2 of FIG. 1 and illustrating a seat back connection assembly.

Referring now to FIGS. 1-2, the cane clamp 14 is removably connected to the angle and depth adjustment assembly 18 by a fastener 62, and more specifically by a quick release fastener 62. The second clamp arm 30 includes a first link 66 that defines a first aperture (not shown), while the angle and depth adjustment assembly 18 includes a second link 70 that defines a second aperture (not shown). The quick release fastener 62 includes a cam lever 74 coupled to an expanding post 78. The expanding post 78 is configured to expand and contract based on the configuration of the cam lever 74. When the first and second apertures are aligned, the apertures are configured to receive the quick release fastener 62 (as shown in FIG. 1).

In the illustrated embodiment, the second link 70 can carry the quick release fastener 62, by receiving a portion of the quick release fastener 62 through the second aperture (not shown). For example, the quick release fastener 62 can be mounted to the second link 70 by the second aperture (not shown). The first aperture (not shown) of the first link 66 can be configured to engage a portion of the expanding post 78. More specifically, in response to the quick release fastener 62 being received by the apertures of the first and second links 66, 70, the expanding post 78 can be actuated into an expanded (or engaged) configuration, facilitating a connection between the quick release fastener 62 and at least the first link 66. More specifically, when the quick release fastener 62 is received by the links 66, 70 and the cam lever 74 is actuated to a closed configuration, which is illustrated in FIGS. 1-2, the post 78 expands to engage a portion of the first link 66 to form the connection with the link 66. For example, the post 78 can expand radially away from the quick release fastener 62 to engage with a portion of the first link 66 that defines the first aperture (not shown). To release the connection, the cam lever 74 can be actuated to an open configuration (not shown) to contract (e.g., radially contract) the post 78. For example, the cam lever 74 can pivot with respect to a handle axis H, shown in FIG. 3. In response to the contraction of the post 78, the post 78 disengages from the portion of the first link 66. When disengaged, the quick release fastener 62 can be removed or withdrawn from the first link 66 (or the first link 66 can be removed from engagement with the quick release fastener 62). In addition, the links 66, 70 can pivot with respect to the expanding post 78 of the quick release fastener 62 (or an axis A that is defined by the expanding post 78 of the quick release fastener 62, shown in FIG. 1). Separately pivoting the links 66, 70 with respect to the axis A facilitates formation of different angles between the links 66, 70. This allows for attachment of the seat back (not shown) to different sized or styles of wheelchairs or chairs. It should be appreciated that the quick release fastener 62 can include similar structure and/or components as the quick release cam mechanism disclosed in U.S. Pat. No. 7,891,739.

Referring generally back to FIGS. 1-6, the angle and depth adjustment assembly 18 connects to the seat back connection mount 22. The illustrated angle and depth adjustment assembly 18 advantageously provides independent adjustment of seat back angle and seat back depth. The angle and depth adjustment assembly 18 includes an angle adjustment portion 82 (or an angle adjustment member 82, or a first portion 82, or a first body 82, or a first bracket 82), a slider locking portion 86 (or an angle adjustment locking member 86, or a slider locking member 86, or a slider locking bracket 86, or a second portion 86, or a second bracket 86), and a connection portion 90 (or a depth adjustment locking member 90, or a connection member 90, or a connection bracket 90, or a third portion 90, or a third bracket 90).

As illustrated in FIG. 1, the angle adjustment portion 82 is coupled to, and preferably integrally formed with, the second link 70. The second clamp arm 30 similarly is coupled to, and preferably integrally formed with, the first link 66. This is to facilitate the removable connection between the cane clamp 14 and the angle and depth adjustment assembly 18.

Referring to FIGS. 1 and 4, the angle adjustment portion 82 includes at least one angle adjustment slot 94 (or angle adjustment aperture 94). In the illustrated embodiment, the angle adjustment portion 82 includes a plurality of arcuate angle adjustment slots 94 that are positioned about an access aperture 98. While the illustrated embodiment depicts two arcuate angle adjustment slots 94, other embodiments of the angle adjustment portion 82 can include one, or three or more arcuate angle adjustment slots 94. In addition, while the illustrated arcuate angle adjustment slots 94 are positioned approximately equidistant from the access aperture 98, in other embodiments the arcuate angle adjustment slots 94 can be positioned at any suitable distance to or in any suitable relationship with the access aperture 98.

Figure 5:
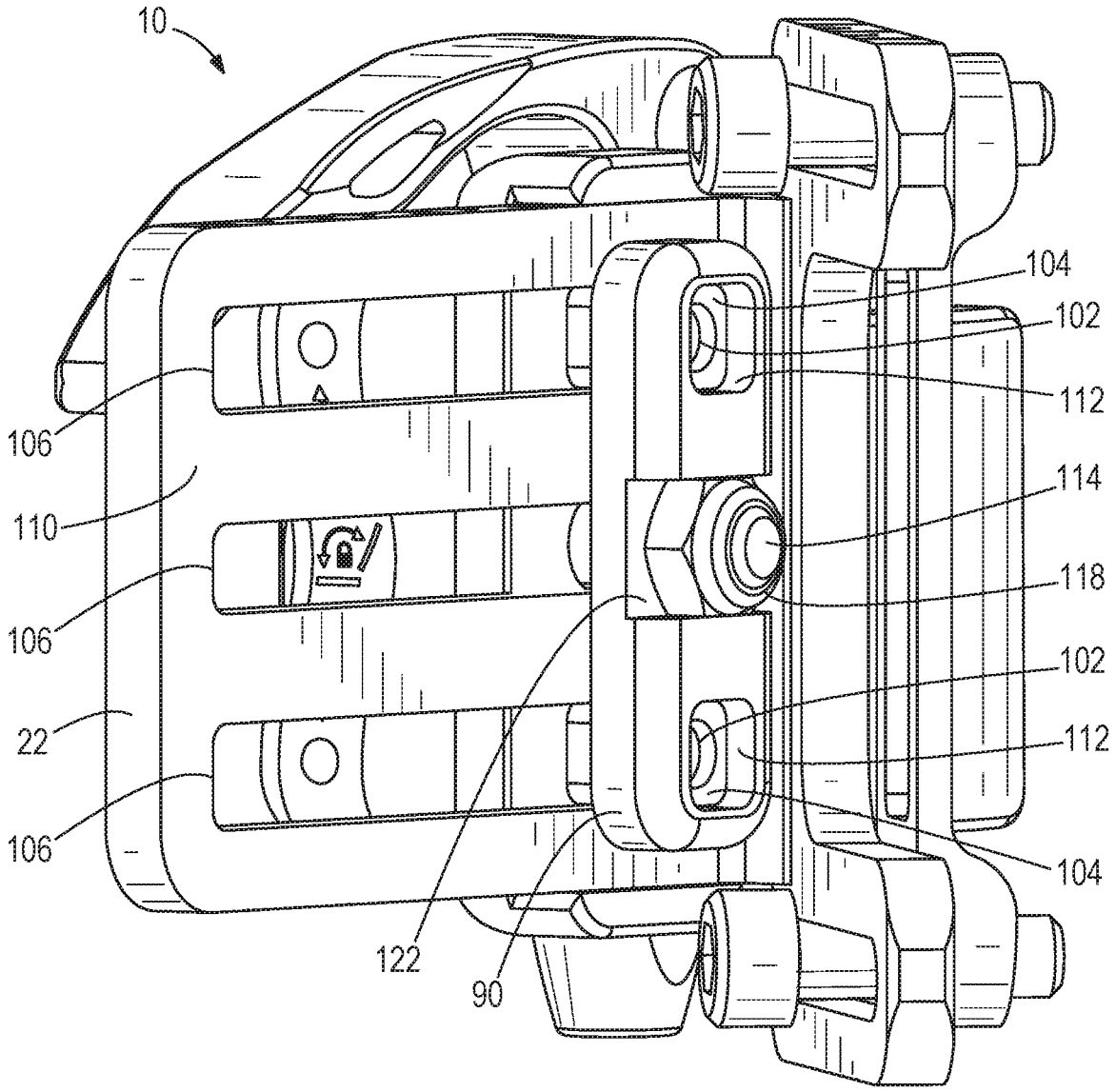
FIG. 5 is a perspective view of the seat back mounting assembly of FIG. 1, taken along line 5-5 of FIG. 4.

With reference to the arcuate angle adjustment slots 94, each slot 94 respectively receives a fastener 102 (or an angle fastener 102, shown as a bolt 102). Once received, each fastener 102 passes through the respective arcuate angle adjustment slot 94 of the angle adjustment portion 82, and engages or connects to the slider locking portion 86 (shown in FIGS. 3 and 6). As illustrated in FIGS. 2 and 5, each fastener 102 is received by a respective extension or projection 104 formed by the slider locking portion 86. Each extension 104 can be formed by a portion of the slider locking portion 86 that extends away from the slider locking portion 86 toward the connection portion 90. Each extension 104 can include threads that are complimentary to threads on the fastener 102. Thus, the threads of each extension 104 can be configured to engage threads on the fastener 102 to form a connection between the fasteners 102 and the slider locking portion 86 (and in turn a connection between the angle adjustment portion 82 and the slider locking portion 86). Each extension 104 extends through a respective slot 106 in a mounting member 110 of the seat back connection mount 22, and is received by a corresponding aperture 112 in the connection portion 90. The extensions 104 are keyed to slide within each respective slot 106, and keyed to be received by the respective aperture 112 in the connection portion 90. It should be appreciated that while the fasteners 102 secure the angle adjustment portion 82 and the slider locking portion 86, in the illustrated embodiment of FIGS. 1-6 the fasteners 102 do not secure (or otherwise form an attachment connection between) the slider locking portion 86 and the connection portion 90. Instead, the extensions 104 are each slidably received by the apertures 112 in the connection portion 90. This couples the slider locking portion 86 to the connection portion 90, but does not secure the slider locking portion 86 to the connection portion 90 by the fasteners 102 (see FIG. 5).

Referring back to FIGS. 1 and 4, and with reference to the access aperture 98, the aperture 98 receives a fastener 114 (or a depth fastener 114, shown as a bolt 114), allowing a portion of the fastener 114 to pass through the angle adjustment portion 82. Once a portion of the fastener 114 is received by the access aperture 98, the fastener 114 passes through an aperture (not shown) provided through the slider locking portion 86, through a respective slot 106 in the mounting member 110 of the seat back connection mount 22, and is received by and engages with the connection portion 90 (shown in FIG. 5). As illustrated in FIG. 5, the fastener 114 engages a corresponding nut 118 positioned in a depression or slot 122 defined by a portion of the connection portion 90. This engagement secures (or otherwise forms an attachment connection between) the slider locking portion 86 and the connection portion 90. It should be appreciated that the access aperture 98 is sized to alternatively receive the nut 118, allowing for the fastener 114 to pass through the connection portion 90, mounting member 110, slider locking portion 86, and angle adjustment portion 82 to engage a nut 118 in the angle adjustment portion 82 (i.e., in the opposite direction as disclosed in association with FIGS. 1-6). In an alternative embodiment of the connection portion 90, the connection portion 90 can include a threaded aperture that is configured to engage corresponding threads on the fastener 114, eliminating the need for a separate nut 118. In the illustrated embodiment, the back connection mount 22, and more specifically the mounting member 110, includes a plurality of slots 106. The illustrated slots 106 are approximately parallel to one another. While the illustrated embodiment depicts three slots 106, in other embodiments, the back connection mount 22 and/or the mounting member 110 can include a single slot 106, two slots 106, or three or more slots 106. For example, in embodiments with a single slot 106, the fasteners 102, 114 can be received by the single slot 106. This may require a repositioning of the angle adjustment slot(s) 94 and the access aperture 98 of the angle adjustment portion 82 to align the fasteners 102, 114 for receipt by the slot 106.

Figure 6:
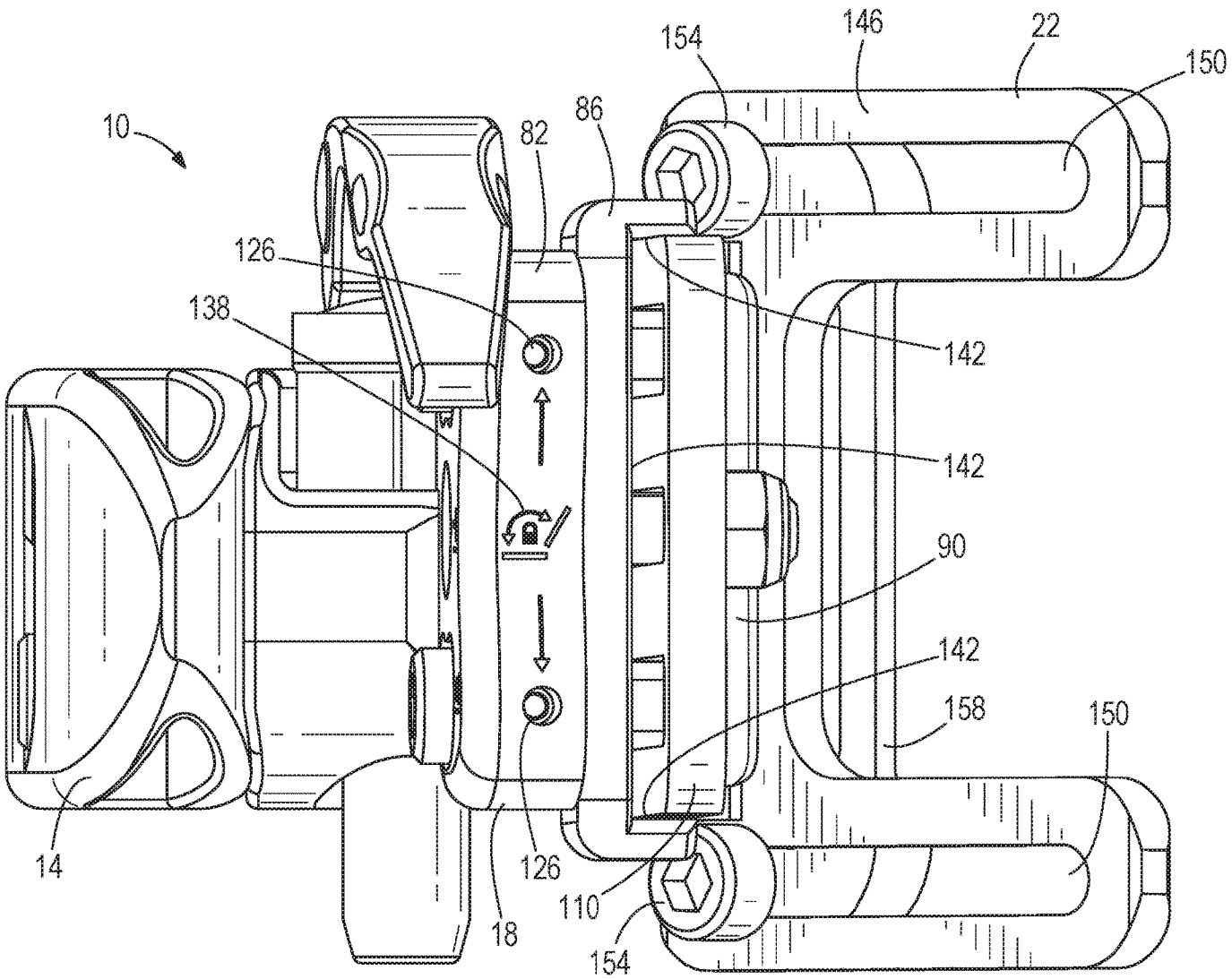
FIG. 6 is a perspective view of the seat back mounting assembly of FIG. 1, taken along line 6-6 of FIG. 1.

As illustrated in FIGS. 1, 4, and 6, the angle adjustment portion 82 can include a plurality of fasteners 126 (or set screws 126). For example, the number of fasteners 126 can correspond with the number of angle fasteners 102. The fasteners 126 extend into a portion of the angle adjustment portion 82 and engage a respective fastener 102. The fasteners 126 assist with retaining the angle adjustment portion 82 in the selected angular configuration to avoid unintentional or undesirable changes to the seat back angle. While the fasteners 126 are illustrated in the figures as set screws 126, in other embodiments any releasable fastener suitable for securing the angle adjustment portion 82 to a portion of the fasteners 102 can be used (e.g., bolts, screws, and the like).

The angle adjustment portion 82 can include one or more indicia to provide assistance to a user in adjusting the seat back angle and/or seat back depth. As illustrated in FIG. 4, the indicia can include an illustration 130 identifying the appropriate fasteners 102 associated with adjustment of the seat back angle, and an illustration 134 identifying the appropriate fastener 114 associated with adjustment of seat back depth. In addition, as shown in FIG. 6, the indicia can include an illustration 138 identifying the set screws 126 that engage respective fasteners 102 to assist with retaining the angle adjustment portion 82 in the selected angular configuration. Indicia can also be included with any other set screws or fasteners associated with the seat back mounting assembly 10, such as an illustration 140 (see FIG. 4) identifying the set screw 58 that engages with the wheelchair cane (not shown) to assist with retaining the connection between the cane clamp 14 and the wheelchair cane.

Referring now to FIG. 6, the illustrated slider locking portion 86 is positioned between the angle adjustment portion 82 and the mounting member 110. In addition, the illustrated slider locking portion 86 is positioned on a first side (or one side) of the mounting member 110, while the connection portion 90 is positioned on a second side (or opposite side) of the mounting member 110. Stated another way, the slider locking portion 86 and the connection portion 90 are positioned on opposite sides of the mounting member 110, with the mounting member 110 sandwiched between the slider locking portion 86 and the connection portion 90. The slider locking portion 86 can define a recess 142 (or a channel 142) that is configured to receive the mounting member 110. In the illustrated embodiment, the recess 142 has a substantially U-shaped cross-sectional shape, and is configured to receive the mounting member 110. In other embodiments, the recess 142 can be any suitable shape, and/or can be defined by the connection portion 90. It should also be appreciated that the slider locking portion 86 and the connection portion 90 are respectively brackets or bracket members that interconnect with each other, and further interconnect with the mounting member 110.

The connection between the angle adjustment portion 82 and the slider locking portion 86 (by the fasteners 102) facilitates the seat back angle adjustment. The connection between the slider locking portion 86 and the connection portion 90 (by the fastener 114) facilitates the seat back depth adjustment. In the illustrated embodiment of FIGS. 1-6, the seat back angle adjustment and the seat back depth adjustment are independent, meaning they are each adjustable separate from the other. Stated another way, the seat back angle adjustment can be adjusted while the seat back depth adjustment is maintained. Similarly, the seat back depth adjustment can be adjusted while the seat back angle adjustment is maintained. To adjust the seat back angle independent of seat back depth, the fasteners 102 are loosened from engagement with the slider locking portion 86, while the fastener 114 maintains engagement between the slider locking portion 86 and the connection portion 90. Once the fasteners 102 are loosened, the angle adjustment portion 82 can rotate or pivot about (or relative to) the fastener 114. Stated another way, the angle adjustment portion 82 can rotate or pivot about (or relative to) an axis that is defined by the fastener 114. The angle adjustment portion 82 also rotates or pivots with respect to the slider locking portion 86, the connection portion 90, and the mounting member 110. As the angle adjustment portion 82 rotates (or pivots) about the fastener 114, each fastener 102 slides within the respective arcuate angle adjustment slot 94 (see FIG. 4). Once a desired angle of the seat back is established, each fastener 102 is tightened into engagement with the slider locking portion 86, forming the attachment connection between the angle adjustment portion 82 and the slider locking portion 86. It should be appreciated that the quantity of rotation (or pivot) of the angle adjustment portion 82 with respect to the fastener 114, the slider locking portion 86, the connection portion 90, and/or the mounting member 110 is defined by the angle adjustment slot 94. The length and/or angle of curvature of each angle adjustment slot 94 can determine the quantity of rotation (or pivot), as each fastener 102 slides within the respective angle adjustment slot 94 as the angle adjustment portion 82 rotates or pivots.

To adjust the seat back depth independent of the seat back angle, the fastener 114 is loosened from engagement with the connection portion 90 (e.g., by loosening the connection with the nut 118, etc.), while the fasteners 102 maintain engagement between the angle adjustment portion 82 and the slider locking portion 86. Once the fastener 114 is loosened, the slider locking portion 86 can slide along the mounting member 110 to select a desired seat back depth. More specifically, each extension 104 of the slider locking portion 86 can laterally slide within an associated slot 106 of the mounting member 110. Once a desired seat back depth is selected (or established), the fastener 114 is tightened into engagement with the connection portion 90 (e.g., by tightening the connection with the nut 118, etc.), forming the attachment connection between the slider locking portion 86 and the connection portion 90.

Figure 7:
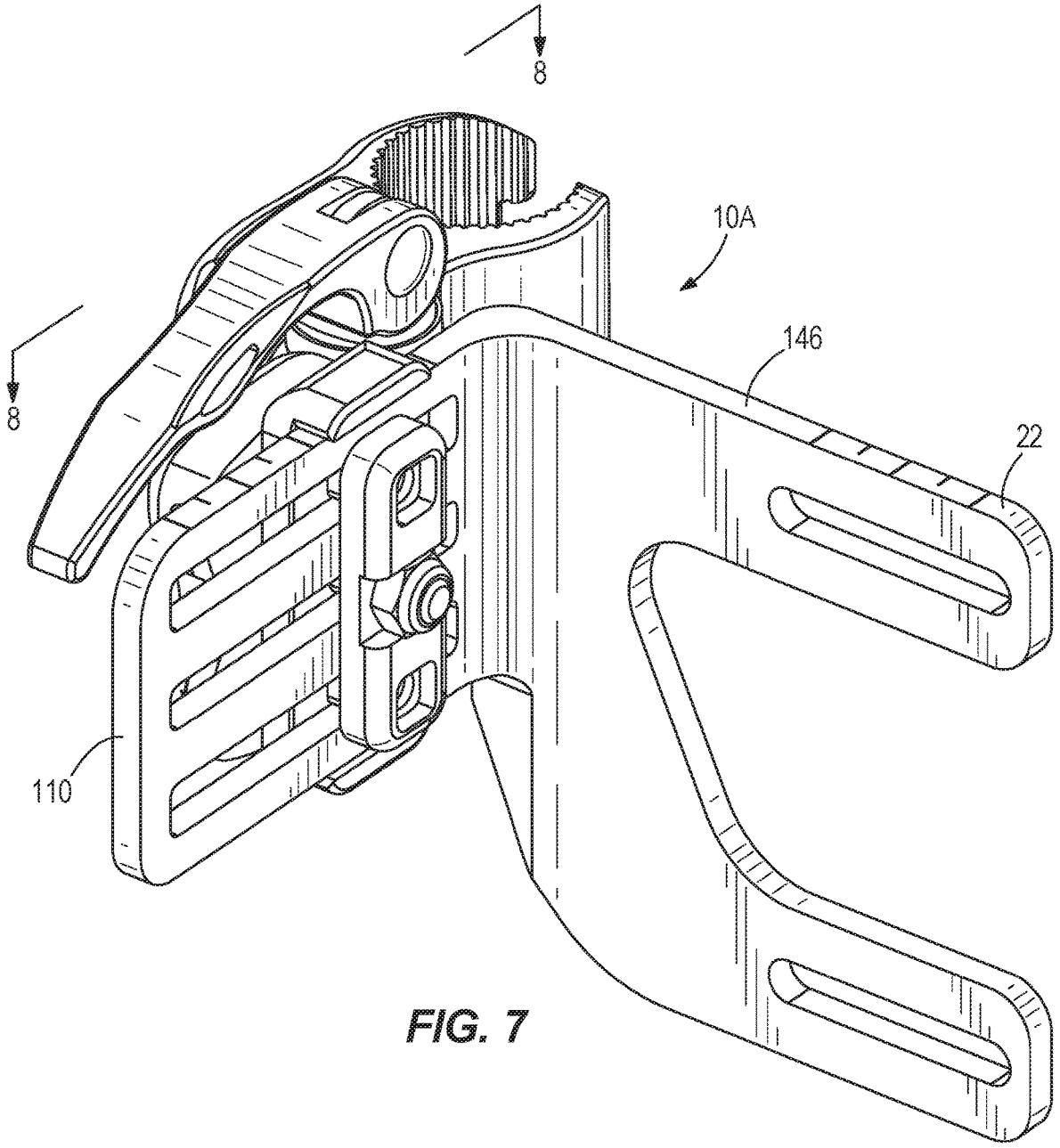
FIG. 7 is a perspective view of the seat back mounting assembly of FIG. 1, illustrating an alternative embodiment of a seat back connection assembly.
Figure 8:
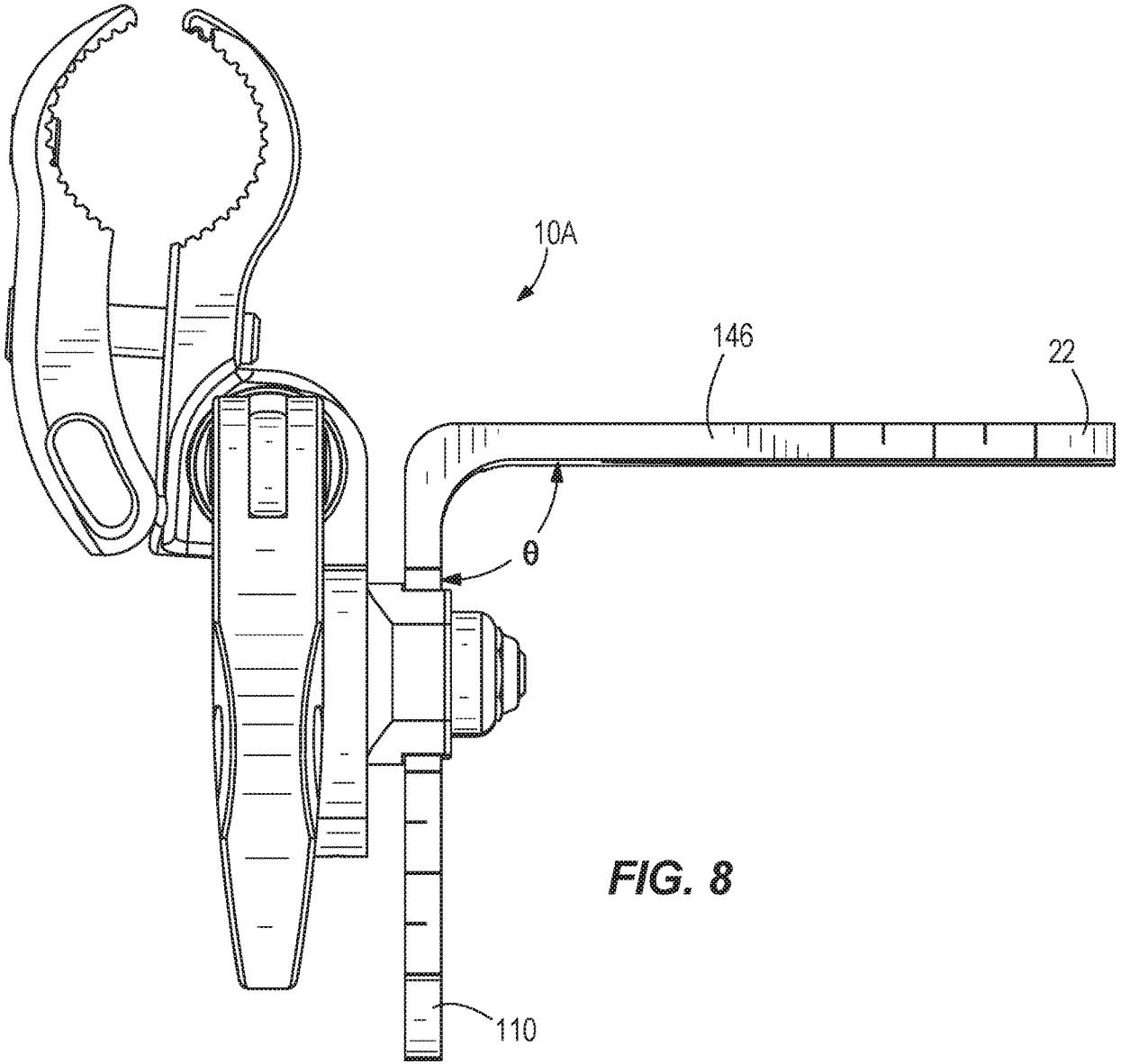
FIG. 8 is a plan view of the seat back mounting assembly of FIG. 7, taken along line 8-8 of FIG. 7.
Figure 9:
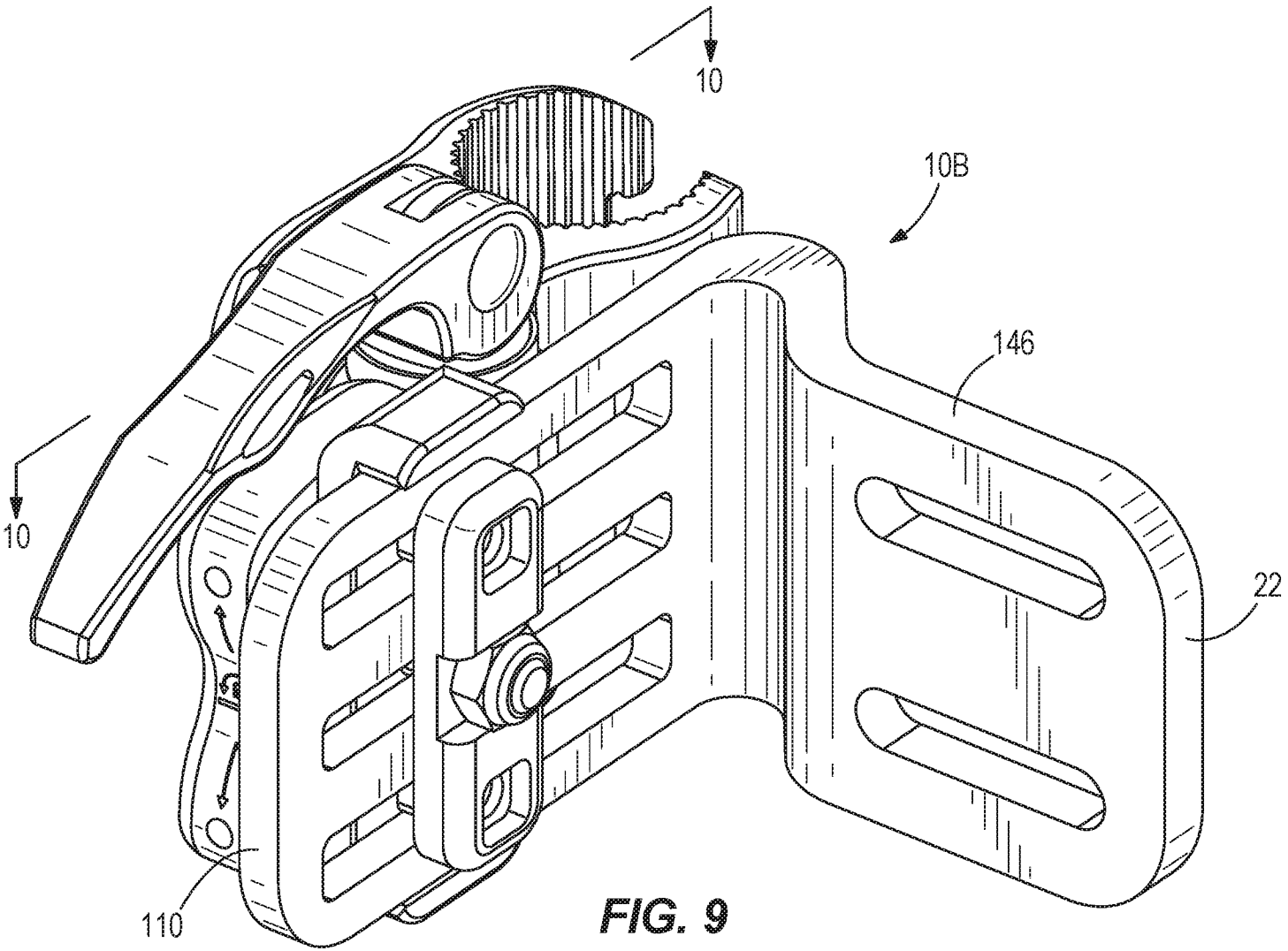
FIG. 9 is a perspective view of the seat back mounting assembly of FIG. 1, illustrating another alternative embodiment of a seat back connection assembly.
Figure 10:
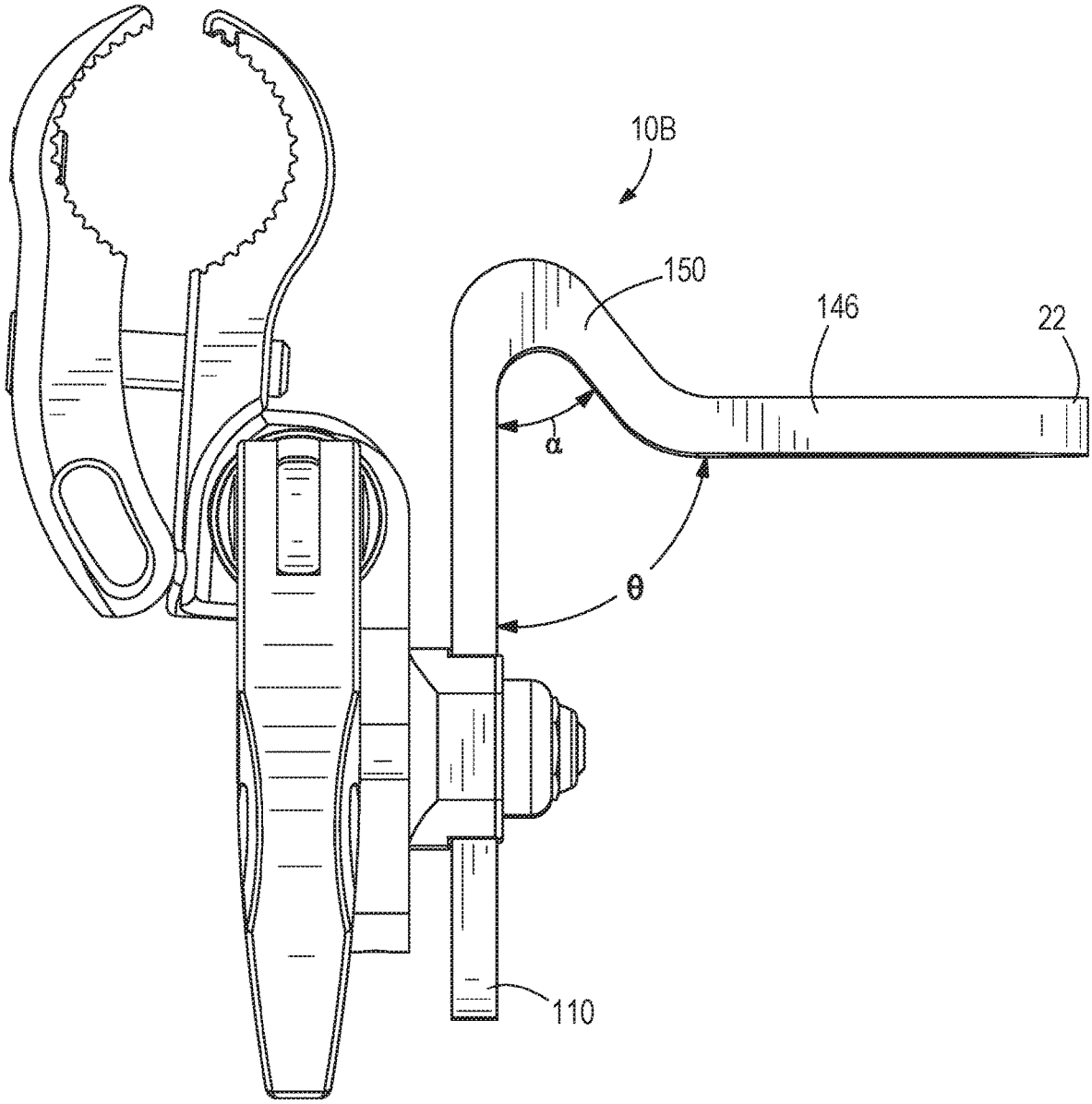
FIG. 10 is a plan view of the seat back mounting assembly of FIG. 9, taken along line 10-10 of FIG. 9.

Referring back to FIG. 3, the seat back connection mount 22 includes the mounting member 110 (or a first mounting member 110) and a seat back mounting member 146 (or second mounting member 146). The mounting members 110, 146 of the illustrated embodiment are integrally formed of a unitary construction. In other embodiments, the mounting members 110, 146 can instead be defined by two or more different elements (or components) that can be permanently secured or selectively (or removably) secured to one another in any suitable manner of fastening. In the illustrated embodiment, the mounting members 110, 146 are arranged with respect to one another at an angle θ, depicted as an oblique angle (i.e. the mounting members 110, 146 are neither parallel nor perpendicular to each another). More specifically, angle θ is depicted as an angle of approximately 45 degrees. In other embodiments, the mounting members 110, 146 can be arranged at any suitable angle θ. For example, FIGS. 7-8 illustrate an alternative embodiment of the seat back mounting assembly 10A, where the mounting members 110, 146 are arranged at an angle θ that is approximately 90 degrees (or the mounting members 110, 146 are approximately perpendicular). As another example, FIGS. 9-10 illustrate an alternative embodiment of the seat back mounting assembly 10B, where the mounting members 110, 146 are arranged at an angle θ that is approximately 90 degrees (or the mounting members 110, 146 are approximately perpendicular), however a portion 150 of the mounting member 146 is arranged at a different angle to the mounting member 110 than the mounting member 146. As illustrated in FIG. 10, the portion 150 and the mounting member 110 are arranged at an angle α that is depicted as an oblique angle, and more specifically as less than angle θ (i.e., less than ninety degrees). It should be appreciated that the alternative orientations of mounting members 110, 146 are provided to facilitate attachment to different seat back types, arrangements, or constructions. Accordingly, the angles disclosed in the alternative orientations are provided for purposes of example, and the angle θ between the mounting members 110, 146 can be any suitable angle to facilitate attachment to different seat back types, arrangements, or constructions. For example, the angle θ can be greater than one degree, and/or less than one hundred and eighty degrees, or at any suitable angle there between.

Referring back to FIG. 6, the seat back mounting member 146 can include at least one channel 150 (or slot 150). In the illustrated embodiment, the seat back mounting member 146 defines a plurality of channels 150). Each channel 150 can be configured to receive a mounting fastener 154 (illustrated as a bolt 154). Once received by the respective channel 150, each fastener 154 is configured to engage with a portion of a seat back (not shown). This engagement attaches the seat back (not shown) to the associated wheelchair (or seat). For example, each fastener 154 can be received by a slot or aperture in a seat back. An example of such a seat back, and the associated seat back slot or aperture can include the disclosed slot 3 in seat back 1 of U.S. Pat. No. 7,891,739. Once engaged with the seat back, the fasteners 154 can connect to a seat back connection bracket 158. It should be appreciated that fasteners 154 can slide along each respective channel 150 in the seat back mounting member 146 to facilitate attachment of the seat back mounting assembly 10 to the seat back.

Figure 11:
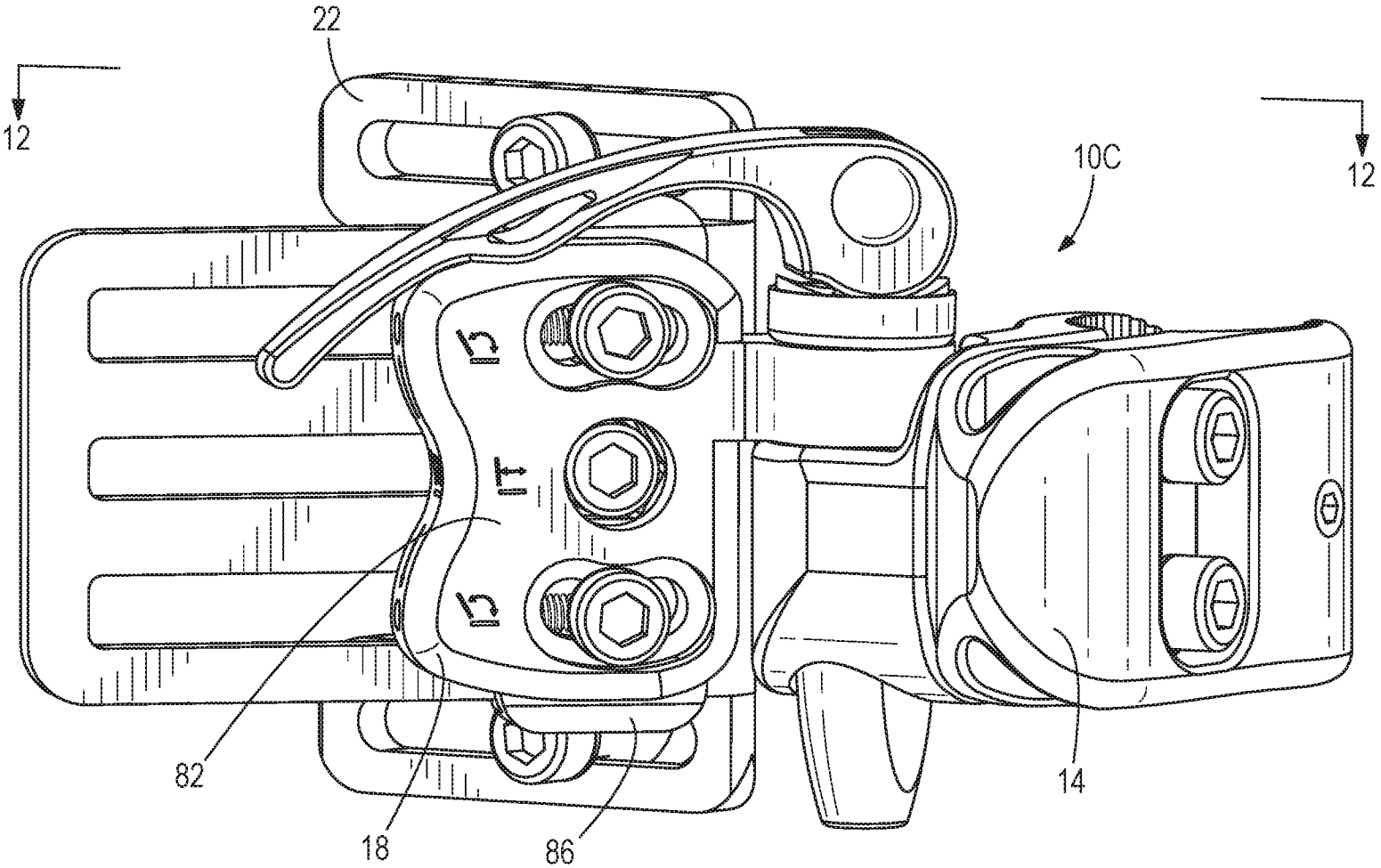
FIG. 11 is a perspective view of another alternative embodiment of the seat back mounting assembly, which is a mirror image of the seat back mounting assembly of FIG. 1.
Figure 12:
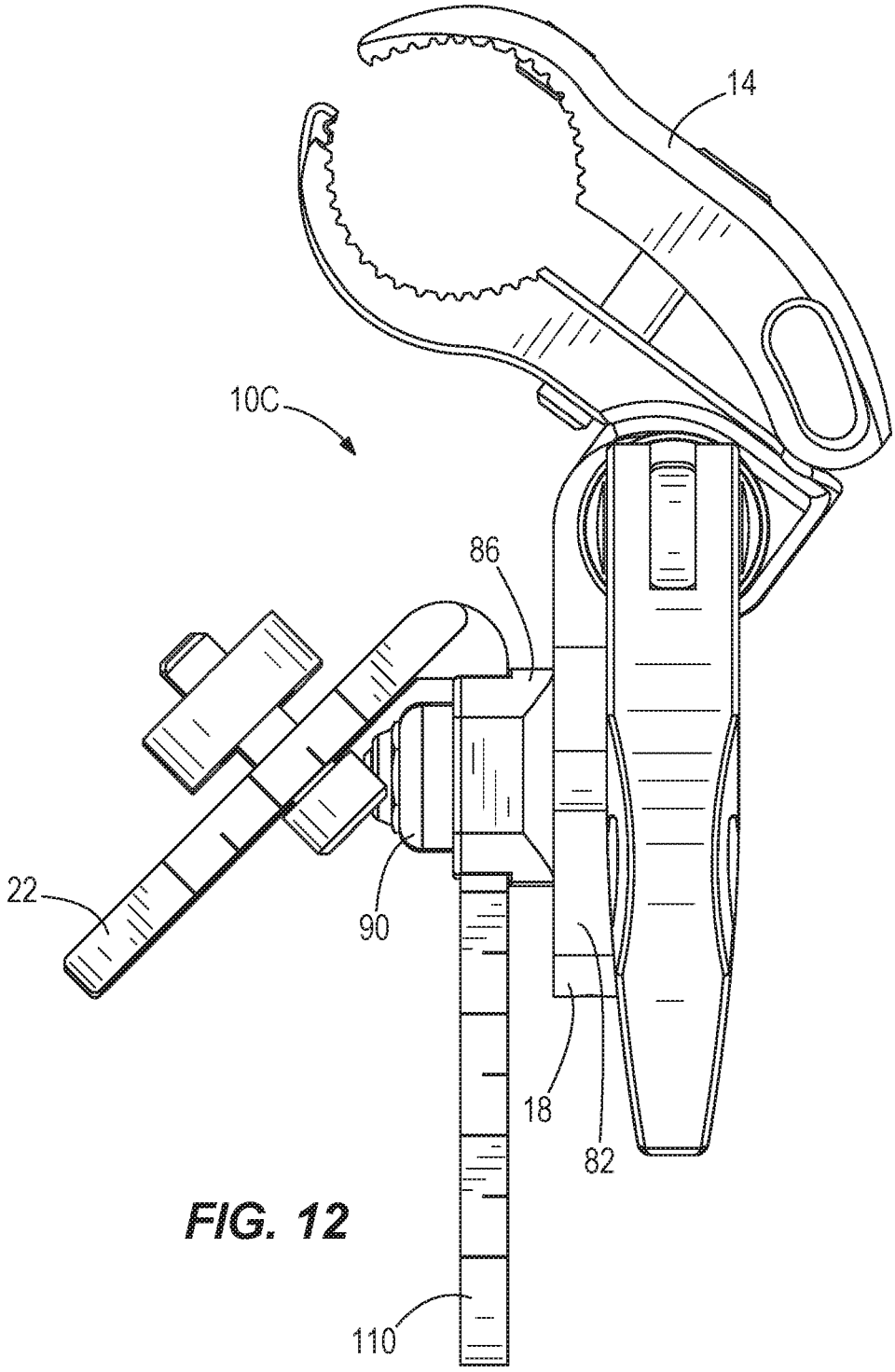
FIG. 12 is a plan view of the seat back mounting assembly of FIG. 11, taken along line 12-12 of FIG. 11.

While FIGS. 1-10 illustrate embodiments of a left side or a left orientation seat back mounting assembly 10, 10A, 10B, FIGS. 11-12 illustrate an embodiment of a right side or a right orientation seat back mounting assembly 10C. The seat back mounting assembly 10C is substantially the same as the seat back mounting assembly 10, except that the seat back mounting assembly 10C is a mirror image of the seat back mounting assembly 10. Accordingly, like components are identified with like numbers and function in the substantially same way. The right side mounting assembly 10C is configured to mount a seat back (not shown) to a right side back post (or wheelchair cane or back cane, not shown), the right side being viewed when facing a backside of the wheelchair (not shown), or by a user sitting in the wheelchair. In some embodiments, to connect a seat back to wheelchair canes, both a left side seat back mounting assembly 10 and a right side seat back mounting assembly 10C are used. The left side seat back mounting assembly 10 couples to the left side wheelchair cane, while the first side seat back mounting assembly 10C couples to the right side wheelchair cane. The left side seat back mounting assembly 10 engages a left side of the seat back, while the right side seat back mounting assembly 10 engages a right side of the seat back.

One or more aspects of the seat back mounting assembly 10 provide certain advantages. For example, some embodiments of the mounting assembly 10 not only mount a seat back, but can also provide independent multi-direction adjustment of the seat back. More specifically, the mounting assembly 10 can allow for seat back depth adjustment independent of seat back angle adjustment. In some embodiments, seat back depth adjustment is accomplished by loosening one or more fasteners as described herein without loosening fasteners securing the seat back in a particular seat back angle (or otherwise not permitting the seat back angle to change), adjusting the depth of the seat back while the seat back angle is secured in its original seat back angle, and then tightening the one or more fasteners to secure the seat back in a new seat back depth position. Alternatively or in addition, in some embodiments seat back angle adjustment is accomplished by loosening one or more fasteners as described herein without loosening fasteners securing the seat back at a particular seat back depth (or otherwise not permitting the seat back depth to change), adjusting the angle of the seat back while the seat back depth is secured in its original seat back depth, and then tightening the one or more fasteners to secure the seat back in a new seat back angle. This provides for easier adjustment of a seat back, even while an individual sits in the seat. These and other advantages are realized by the disclosure provided herein.

What is claimed is:

1. A seat back angle and depth adjustment assembly comprising:

an angle adjustment member that includes an aperture;

a connection mount defining a slot; and a fastener received by the aperture and extending through the slot, wherein to adjust a seat back depth, the angle adjustment member carries the fastener and is configured to laterally slide relative to the connection mount, wherein to adjust a seat back angle, the angle adjustment member is configured to rotate relative to the connection mount around the fastener, and wherein adjustment of the seat back angle is independent of adjustment of the seat back depth.

2. The seat back angle and depth adjustment assembly of claim 1, wherein the angle adjustment member is coupled to a cane clamp.

3. The seat back angle and depth adjustment assembly of claim 2, wherein the angle adjustment member is coupled to the clamp by a quick release fastener.

4. The seat back angle and depth adjustment assembly of claim 3, wherein the quick release fastener includes a cam lever that is operably connected to an expanding post, wherein in response to actuation of the cam lever, the expanding post is configured to expand or contract.

5. The seat back angle and depth adjustment assembly of claim 1, further comprising a depth adjustment locking member, wherein the fastener is configured to engage the depth adjustment locking member.

6. The seat back angle and depth adjustment assembly of claim 5, wherein to adjust a seat back depth, the depth adjustment locking member is configured to laterally slide with the angle adjustment member relative to the connection mount.

7. The seat back angle and depth adjustment assembly of claim 5, wherein the slot is a first slot, and further comprising:

a second slot defined by the connection mount, a portion of the depth adjustment locking member is received by the second slot.

8. The seat back angle and depth adjustment assembly of claim 7, wherein to adjust a seat back depth, the portion of the depth adjustment locking member received by the second slot is configured to laterally slide within the second slot as the angle adjustment member slides relative to the connection mount.

9. The seat back angle and depth adjustment assembly of claim 5, wherein the aperture is a first aperture, the fastener is a first fastener, and the slot is a first slot, and further comprising:

a second fastener received by a second aperture in the angle adjustment member, the second fastener extending through a second slot defined by the connection mount, wherein the second fastener is configured to engage an angle adjustment locking member.

10. The seat back angle and depth adjustment assembly of claim 9, wherein the angle adjustment locking member is positioned on a first side of the connection mount, and the depth adjustment locking member is positioned on a second side of the connection mount.

11. The seat back angle and depth adjustment assembly of claim 10, wherein the first side of the connection mount is opposite the second side of the connection mount.

12. The seat back angle and depth adjustment assembly of claim 10, wherein the first slot is offset from the second slot.

13. The seat back angle and depth adjustment assembly of claim 12, wherein the first slot is parallel to the second slot.

14. The seat back angle and depth adjustment assembly of claim 10, wherein the angle adjustment locking member defines a recess that is configured to receive a portion of the connection mount.

15. The seat back angle and depth adjustment assembly of claim 10, wherein the angle adjustment locking member defines an extension that is received the second slot defined by the connection mount.

16. The seat back angle and depth adjustment assembly of claim 15, wherein the extension is received by an aperture defined by the depth adjustment locking member.

17. A seat back angle and seat back depth adjustment assembly comprising:

a first bracket including a first aperture;

a first mounting member defining a first elongated slot; and a first fastener received by the first aperture and the elongated slot, wherein to select a seat back angle position, the first bracket rotates relative to the first mounting member, the first bracket rotates around an axis of rotation defined by the first fastener, wherein to select a seat back depth position, the first bracket slides relative to the first mounting member, the first bracket carries the first fastener, and the first fastener slides within the elongated slot, and wherein the assembly is configured to select the seat back angle position while maintaining the selected seat back depth position, or the assembly is configured to select the seat back depth position while maintaining the selected seat back angle position.

18. The seat back angle and seat back depth adjustment assembly of claim 17, further comprising:

a second bracket configured to receive the first fastener, the second bracket positioned on a side of the first mounting member opposite the first bracket.

19. The seat back angle and seat back depth adjustment assembly of claim 17, wherein the first bracket including a second curved aperture, the first mounting member defining a second elongated slot, and further comprising:

a second fastener received by the second aperture and the second elongated slot, wherein to select the seat back angle position, as the first bracket rotates relative to the first mounting member the second fastener slides within the second curved aperture, and wherein to select the seat back depth position, the second fastener slides within the second elongated slot.

20. The seat back angle and seat back depth adjustment assembly of claim 19, further comprising:

a second bracket configured to receive the first fastener, the second bracket positioned on a side of the first mounting member opposite the first bracket; and a third bracket configured to receive the second fastener, the third bracket positioned on the same side of the first mounting member as the first bracket, the third bracket positioned between the first bracket and the first mounting member.

* * * * *